US005775323A

United States Patent [19]

Knott

[11] Patent Number: 5,775,323

[45] Date of Patent: Jul. 7, 1998

[54] REGULATOR CONVERSION SYSTEM

[75] Inventor: Gilbert L. Knott, Colchester, Conn.

[73] Assignee: Tech-One, Inc., Colchester, Conn.

[21] Appl. No.: 778,887

[22] Filed: Jan. 3, 1997

[51] Int. Cl.[6] ..... A62B 9/04

[52] U.S. Cl. ..... 128/202.27; 128/201.28; 128/204.26

[58] Field of Search ..... 128/200.24, 202.27, 128/201.11, 201.19, 204.18, 205.24, 205.25, 204.26, 201.28, 201.24, 206.15, 200.28, 202.11, 202.16, 203.29; 285/148.22, 148.23

[56] References Cited

U.S. PATENT DOCUMENTS 2,168,695 8/1939 Asasi ..... 128/201.15

3,481,333 12/1969 Garrison .

3,521,626 7/1970 Hashimoto et al. ..... 128/201.19

4,029,092 6/1977 Morgan .

4,648,394 3/1987 Wise ..... 128/201.24

*Primary Examiner*—Vincent Millin

*Assistant Examiner*—V. Srivastava

*Attorney, Agent, or Firm*—Fishman, Dionne, Cantor & Colburn

[57] ABSTRACT

An adapter for connecting a plurality of different manufacturers' second stage regulators to commercially available full face masks for use in self contained breathing situations.

14 Claims, 5 Drawing Sheets

REGULATOR CONVERSION SYSTEM

BACKGROUND OF THE INVENTION

Prior Art

Scuba diving has become increasingly more popular in recent years, thus precipitating a plethora of new products and technology for the industry. For many years, sport diving was generally limited to the diver wearing a goggles-type mask to cover his eyes and holding a regulator in his mouth for breathing. In order to facilitate the holding of the regulator in the mouth a rubber extension is provided which is specifically molded to provide a good seal while held in the diver's mouth. While this is clearly effective for the intended purpose of allowing a human being to dive and stay underwater for extended periods of time, it is uncomfortable in that the diver's mouth must remain tightly sealed around the regulator. This requires long term tension in the muscles of the mouth. Also potentially uncomfortable is the eye/nose mask which generally must make a water tight seal not only around the forehead, which is generally comfortable, but across the cheekbones and bridge of the nose, which can, in general, be uncomfortable. Beyond these drawbacks is that eye/nose mask provide only limited peripheral vision.

Yet another drawback to conventional scuba gear is that it is impossible to communicate verbally to another diver or the surface while employing a second stage regulator by holding the mouthpiece in the diver's mouth.

As technology advances and life becomes increasingly more convenient it is natural to expect that scuba diving equipment will also become more convenient and safer. Probably the most important advance sought in the scuba industry is communication. More particularly, there is a strong desire for the ability to verbally communicate among the sport diving community at a reasonable price. Currently, communication possibilities provided by full face masks is only available to a select few who can afford the exceptionally high price tag of such equipment. More specifically, there is presently only a few manufacturers that provide full face mask systems. Some of these employ protruding rubber connections for second stage regulators. While the system can well hold a regulator, the regulator is so far from the divers face that downward head movement is limited. This is clearly a drawback not only for convenience reasons but for safety reasons as well. One of the prior art systems eliminates this problem by providing a larger, rigid material manifold to receive and support the regulator. This is known to the art as the Interspiro divator® and is highly recognized and well liked by its users. To use the system, however, the diver must not only purchase a mask from this source but also a new regulator that is specifically designed to fit in this mask. While this is an excellent system in the scuba diving art which alleviated many of the drawbacks previously known to the art including those identified above, specifically designed second stage regulators are exceedingly expensive and the industry requires a less expensive alternative which would not require a diver to purchase a new second stage regulator but, rather, could use his existing second stage regulator.

SUMMARY OF THE INVENTION

The above-discussed and other drawbacks and deficiencies of the prior art are overcome or alleviated by the second stage regulator adapter system of the invention.

The invention comprises an adapter system capable of mating any brand of second stage regulator to any, large hard-manifold-type (Interspiro is an example) full face mask. The system includes a water tight interconnection arrangement between the mask manifold and the adapter and between the second stage regulator (which has had the mouthpiece removed therefrom) and the adapter. The adapter system of the invention provides a leak-free mounting at both of these interfaces which maintains all operating parameters of the second stage regulator and the mask. Alternate embodiments of the invention include slightly different tolerances but maintain the basic operational premise. It will further be understood that any full face mask that provides a water tight seal around the face could be modified for use as a scuba mask with the system of the invention by placing a hard manifold therein, said manifold having a water tight seal with the mask and an opening in the manifold for receiving an adapter which will be connected to the regulator as described hereunder. In general, the regulator mounting, seal and retention arrangement are the same for all embodiments and the difference is whether or not a manifold is specifically manufactured for the purpose of receiving the adapter of the invention or whether the manifold was originally adapted to fit a certain regulator or other device and the invention includes an adapter for that manifold.

All embodiments of the invention are highly important to the scuba diving industry since they significantly reduce costs of obtaining a safer and communication friendly underwater breathing system.

The above-discussed and other features and advantages of the present invention will be appreciated and understood by those skilled in the art from the following detailed description and drawings.

BRIEF DESCRIPTION OF THE DRAWING

Referring now to the drawings wherein like elements are numbered alike in the several FIGURES.

DETAILED DESCRIPTION OF THE PREFERRED EMBODIMENTS

Figure 1:
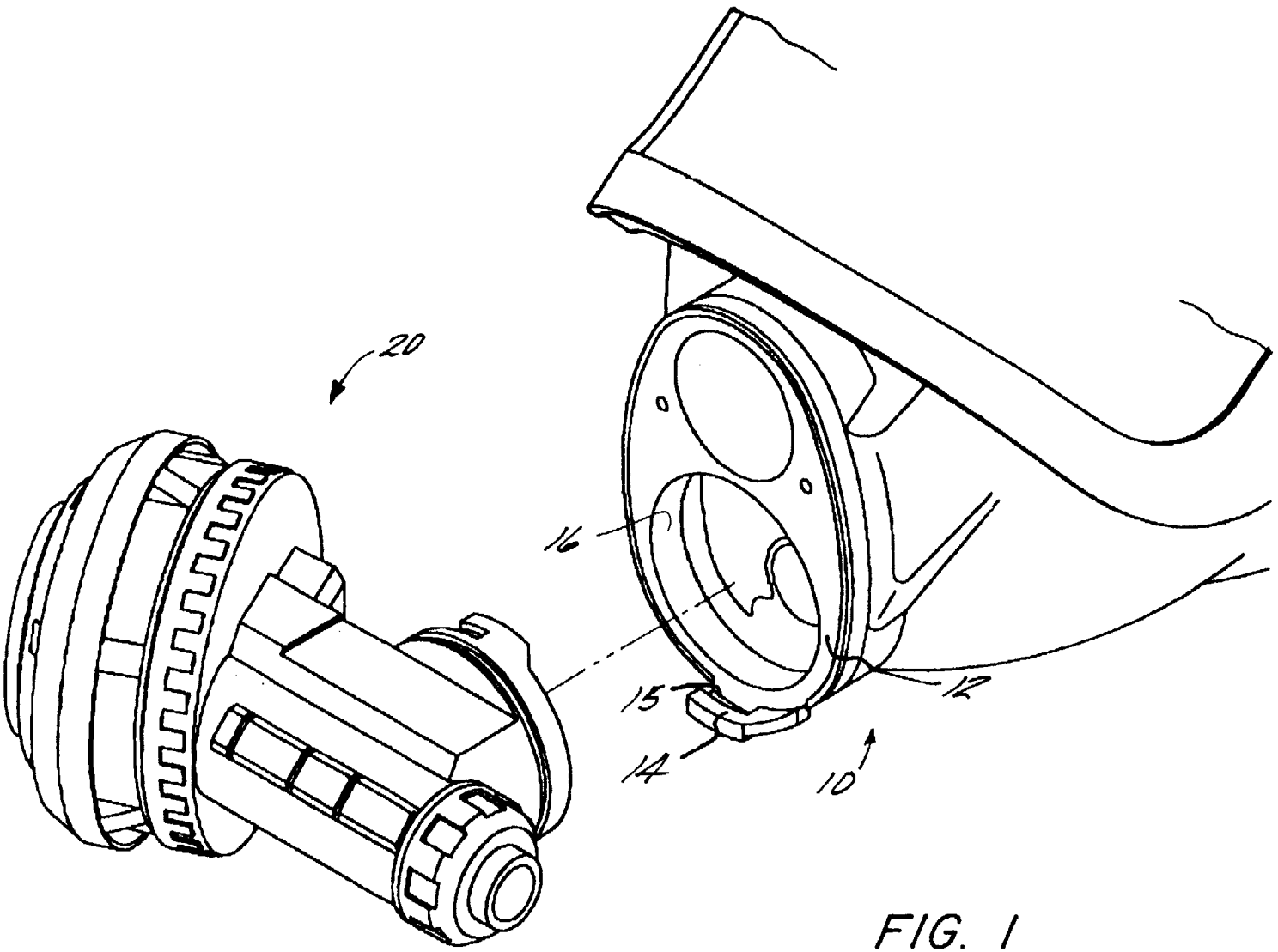
FIG. 1 (PRIOR ART)
FIG. 1 is an exploded view of the prior art.

Referring to FIG. 1, a full face mask of the prior art is referred to generally as 10 and the specially manufactured second stage regulator is illustrated generally at 20. At the front edge of mask 10, manifold 12 includes various features designed to securely retain the specifically designed prior art regulator in the manifold. These include manifold appendage 14 which defines locking groove 15 and seal flange 18 (not shown in FIG. 1) both of which act in concert to receive and lock the regulator in place. Sealing is accomplished vis-a-vis an o-ring sandwiched between the specifically designed regulator and the regulator recess 16 in the manifold 12. Recess 16 leads to an air intake port and an air exhaust port in communication with the interior of mask 10.

The first embodiment of the invention takes advantage of the features of the prior art manifold 12 discussed above while adapting the manifold 12 to any industry regulator. It should be understood that slight modifications of the adapter may be required to adapt some available regulators however these modifications are well within the bounds of the invention and will be understood by one of ordinary skill in the art subsequent to the reading of this application.

Figure 2:
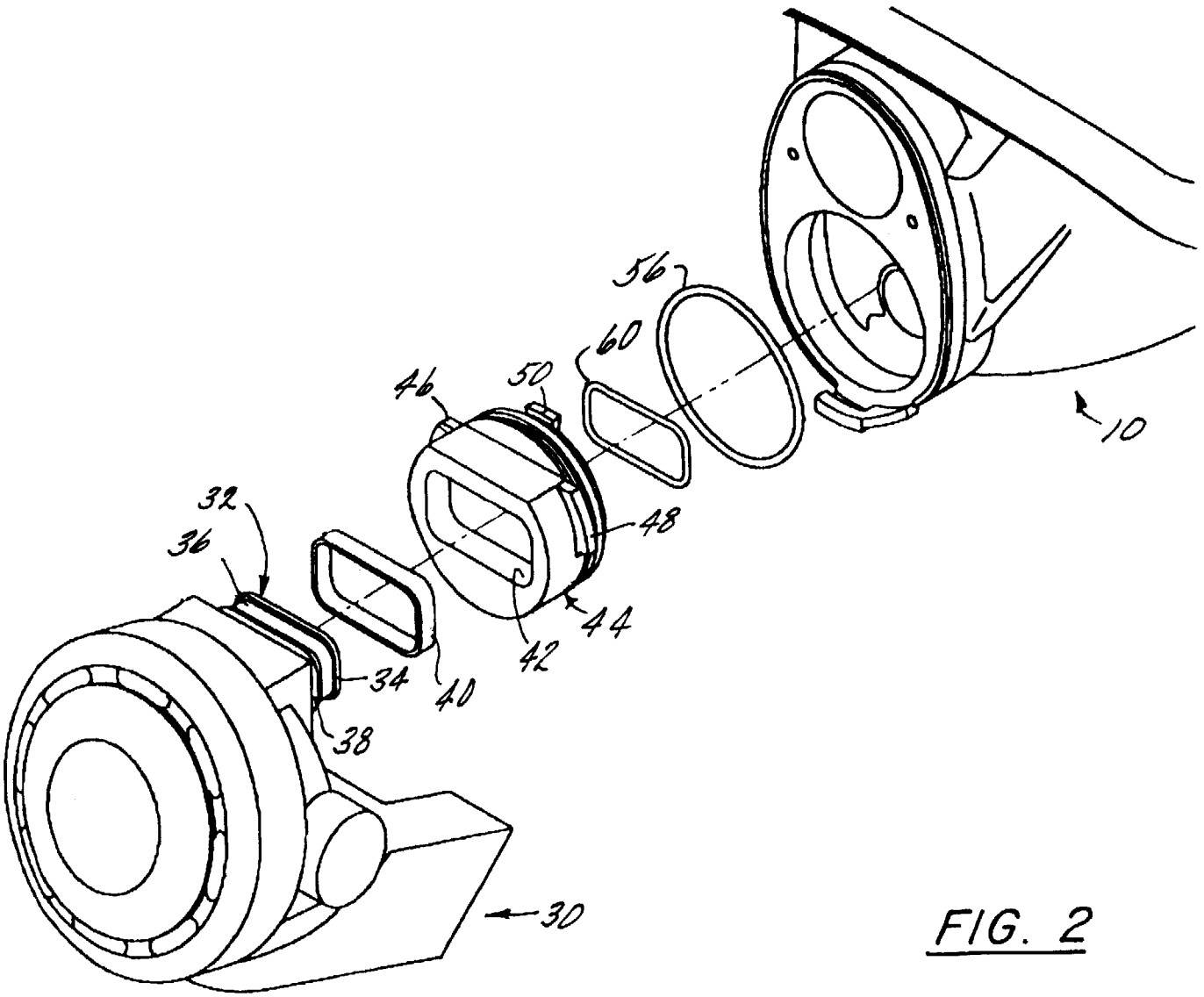
FIG. 2 is an exploded view of the system of the invention adapting a second stage regulator to the full face mask of the prior art.

Referring to FIG. 2, one of ordinary skill in the art will recognize a conventional second stage regulator generally referred to as 30 having a rectangular extension 32 with lip 34, recess 36 and base 38, which parts are generally employed to mount and retain an oral adapter(not shown) for the purpose of holding the second stage regulator in the diver's mouth. The conversion system of the invention includes seal 40 which is preferably constructed of silicone and molded in a shape complimentary to base 38 of the regulator. Commonly, the outlet of the regulator is a rectangle shape and, therefore, the most preferred embodiment of the seal is in a rectangular shape. The seal is preferably constructed of silicone although nitrile and natural rubber are acceptable substitutes. In the most preferred embodiment, the seal 40 is from 3 to 5 millimeters thick to provide a water tight seal when adjacent base 38 and squeezed inside of port opening 42 in conversion stock 44.

Figure 3:
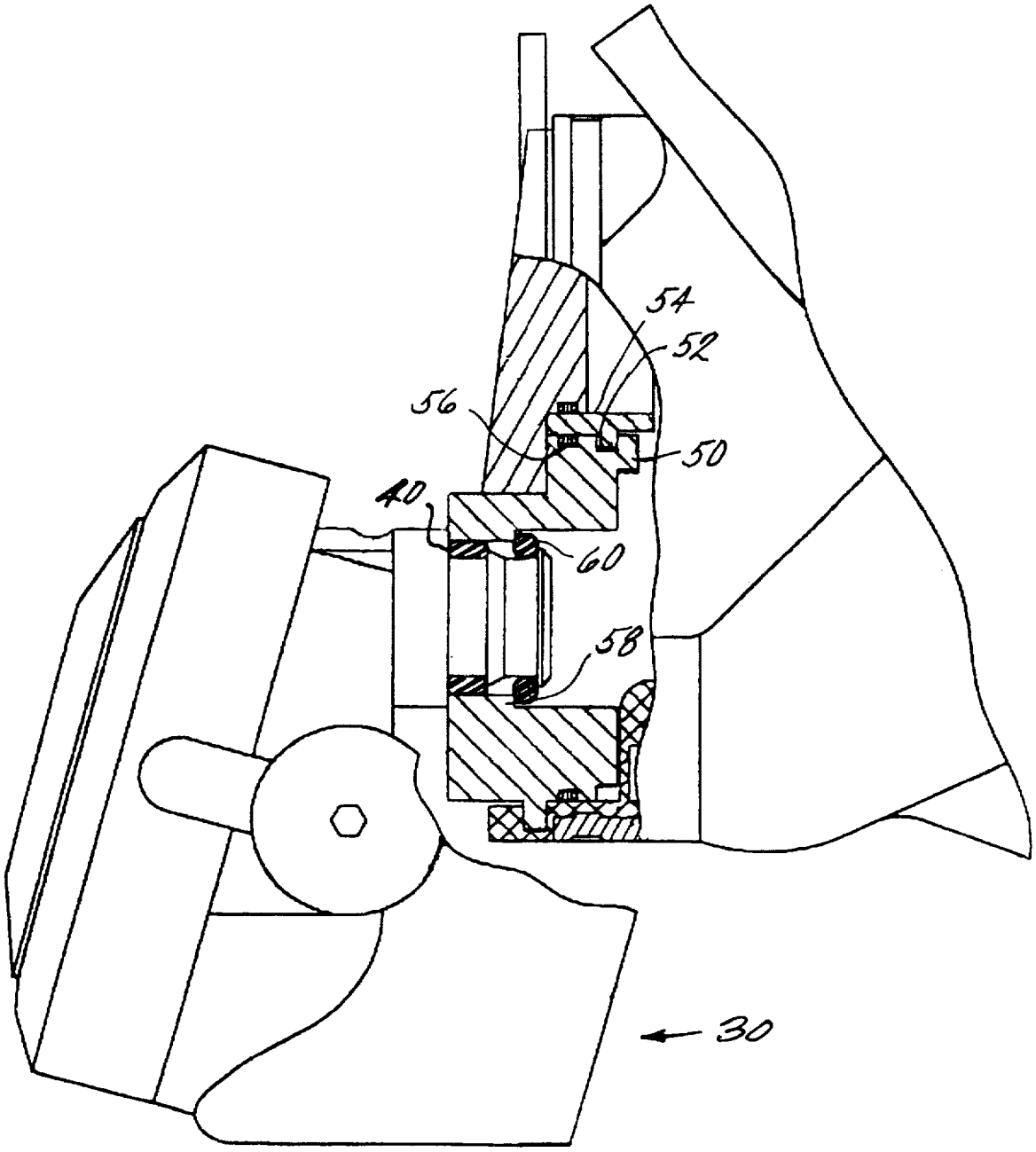
FIG. 3 is a cross-section view of the second stage adapter system of the invention in the engaged position mating a second stage regulator to a full face mask of the prior art.
Figure 4:
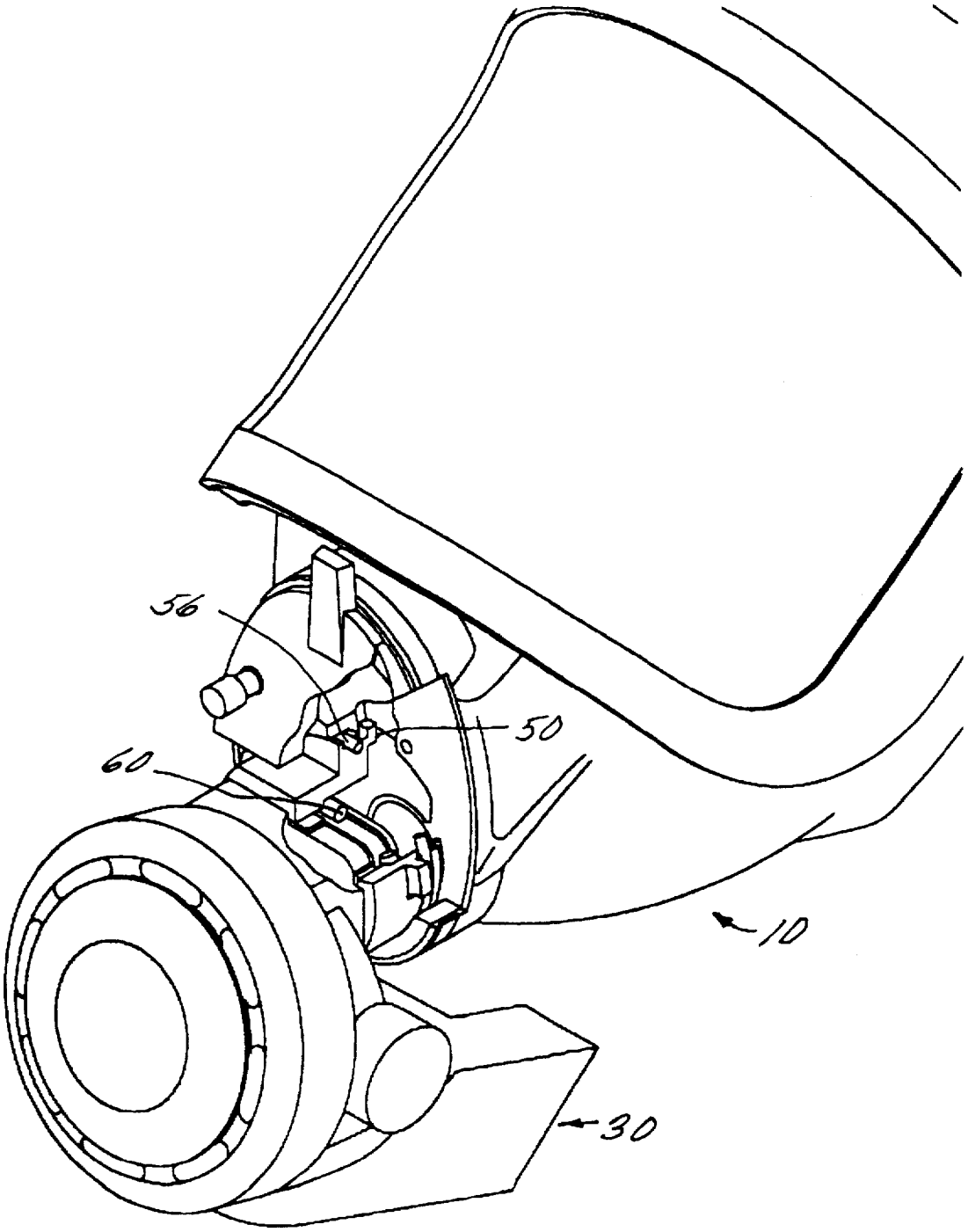
FIG. 4 is a perspective cut away view of the system of the invention engaging a second stage regulator to the mask of the prior art.
Figure 5:
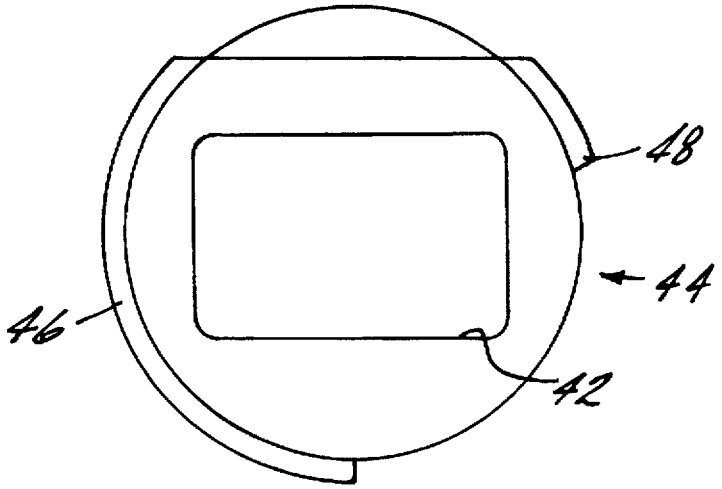
FIG. 5 is an elevation view of the conversion piece (adapter) of the invention.

The conversion stock 44 itself, as will be appreciated by one of skill in the art must be of a relatively complex shape in order to mate two objects not intended to be attached. Conversion stock 44 is most preferably generally of a cylindrical shape and includes a sectioned flange which will be identified as lock flange 46 and location flange 48 (best illustrated in FIG. 5) extending generally perpendicularly and radially from the outer circumferential surface of the cylinder. These two flange sections are formed on the same plane and so, in fact, both locate the conversion stock at the precise depth level within the manifold 12 to facilitate the necessary sealing arrangement. The two flange sections differ in that flange 48 has for its only purpose that described above whereas flange 46 serves that function plus that of locking the stock in place. In order to achieve this result, the bottom(in the drawing) of the flange 46 is received in locking groove 15 in manifold appendage 14. As one of ordinary skill in the art will undoubtedly appreciate, a single locking flange probably would not be sufficient to create a seal capable of underwater use. Referring to FIGS. 2 and 3, the inner lock tab is illustrated as 50. This tab engages with a tongue 52 in manifold 12 to secure the conversion stock 44 into the manifold. While the fit of the stock 44 is tight within the manifold, a seal is still required to prevent water leakage through the assembly. For this purpose an o-ring is preferred. The o-ring 54 is preferably mounted in groove 56 and frictionally engages manifold 12.

Referring to FIGS. 2 and 3 simultaneously, the interconnection of the conventional second stage regulator to the conversion stock of the invention is illustrated. It is important for an understanding of the most preferred operation of the interconnection arrangement to appreciate that port opening 42 extends only a predetermined distance through the stock 44 at a first set of predetermined dimensions. The port is then enlarged in all dimensions to provide shoulder 58 against which o-ring 60 may bear. It should be understood that the shoulder may also simply be a flange. More particularly, seal 40 is placed around base 38, and the extension 32 is then inserted into the opening 42. As illustrated in FIG. 3, there is no space between the extension, the seal and the stock. This provides a good water tight seal for the conversion. To hold the regulator into the conversion stock under pressure, o-ring 60 is placed around extension 32 and is sandwiched between lip 34 and shoulder 58. The arrangement is very easy to install and is easily removable with a thin removal/pry instrument however the arrangement is completely stable in other respects and reliably secures the regulator into the conversion stock 44.

Installing the conversion system in the prior art manifold 12 merely requires that the stock be inserted into the manifold on an angle and then a twist to lock the features discussed above into place. To prevent the regulator from being twisted in the other direction while diving, and disengaging the conversion stock from the mask, the system employs the prior art blocking device (not shown) which employs screws to secure it to the manifold. The blocking device is known and available commercially and therefore requires no further discussion.

In an alternate embodiment of the invention a manifold is provided anew which does not contain the features of the prior art and therefore does not need an adaptive conversion stock to mount a regulator but rather itself provides the opening 42' and shoulder 58' to secure the conventional regulator as it was discussed in conjunction with its attachment to the conversion stock above. The manifold 12' of the invention, it will be understood, is attached to the rubber full face mask in the same manner as the prior art manifold is attached thereto. This is most often through the use of a constrictive strap and an o-ring. This method of attachment will be appreciated by one of skill in the art.

While the preferred embodiments of the invention have been set forth hereinabove it will be understood that modifications thereto are within the scope of the invention as the specific examples are provided by way of illustration and not limitation.

What is claimed is:

1. A system for adapting a conventional scuba regulator having a substantially rectangular projection to a conventional full face scuba mask and manifold having a substantially rectangular opening comprising:

a) a conversion stock having outer features adapted to water tightly engage said manifold and having an axial substantially rectangular aperture therethrough, said aperture being dimensioned to water tightly, operably receive a conventional regulator.

2. A system for adapting a conventional scuba regulator to a conventional full face scuba mask as claimed in claim 1 wherein said conversion stock outer features include a locking flange and a locking tab.

3. A system for adapting a conventional scuba regulator to a conventional full face scuba mask as claimed in claim 1 wherein said aperture includes a projection extending generally perpendicularly toward the axis of said aperture to provide a bearing surface within said aperture, said system including an o-ring to provide an interference engagement between a lip on the conventional regulator and said bearing surface.

4. A system for adapting a conventional scuba regulator to a conventional full face scuba mask as claimed in claim 1 wherein said aperture includes a projection extending generally perpendicularly toward the axis of said aperture to provide a bearing surface within said aperture, said system including a pawl to provide an interference engagement between a lip on the conventional regulator and said bearing surface.

5. A system for adapting a conventional scuba regulator to a conventional full face scuba mask as claimed in claim 3 wherein said bearing surface is a shoulder.

6. A system for adapting a conventional scuba regulator to a conventional full face scuba mask as claimed in claim 4 wherein said bearing surface is a shoulder.

7. A system for adapting a conventional scuba regulator to a conventional full face scuba mask as claimed in claim 1 wherein said aperture is defined by a first set of dimensions at one axial area of said stock and is defined by a second set of dimensions at a second end of said axial area, said second set of dimensions being larger than said first set of dimensions such that a shoulder is formed and a sealing area is formed at the first set of dimensions.

8. A system for adapting a conventional scuba regulator to a conventional full face scuba mask as claimed in claim 7 wherein said system includes a seal dimensioned to sealingly engage the regulator and sealingly nest in the sealing area.

9. A system for adapting a conventional scuba regulator to a conventional full face scuba mask as claimed in claim 2 wherein said outer features further include a seal groove.

10. A system for adapting a conventional scuba regulator to a conventional full face scuba mask as claimed in claim 9 wherein said groove receives an o-ring.

11. A full face mask and regulator system comprising:

a) a conventional full face mask;

b) a conventional regulator having a regulator extension comprising:

1) a base, 2) a recess; and 3) a lip;

c) a manifold in said mask and water tightly engaged with said mask, having at least one axial aperture sized to water tightly engage with the regulator extension, said aperture including an inwardly extending bearing surface;

d) a seal located in water tight connection with said base of said regulator extension, said seal sealingly engageable with said manifold aperture; and e) an o-ring providing an interference engagement between said bearing surface in the manifold and said lip of the regulator to maintain said regulator and said manifold in watertight connection.

12. A method for adapting a conventional full face mask to a conventional regulator comprising:

a) providing a full face mask having a manifold;

b) providing a conventional regulator having an extension having a lip;

c) providing a conversion stock adapted to engage said manifold and having an aperture dimensioned to water tightly engage said regulator extension said aperture having a projection extending inwardly to provide a bearing surface;

d) inserting said extension into said aperture from a first of two axial sides of said conversion stock and installing an o-ring on said extension from the second of said two sides of said conversion stock such that said o-ring is sandwiched between said lip and said bearing surface;

e) engaging said conversion stock with said manifold.

13. A method for adapting a conventional full face mask to a conventional regulator as claimed in claim 12 wherein said inserting also includes installing a seal around said extension prior to insertion into said conversion stock.

14. A full face mask having a manifold in combination with a conversion stock having outer features adapted to water tightly engage an opening in said manifold, said conversion stock providing an axial aperture therethrough, said aperture being dimensioned to water tightly operably receive a conventional regulator.

* * * * *